United States Patent [19]

Wildner et al.

[11] 4,195,541

[45] Apr. 1, 1980

[54] APPARATUS FOR PERFORATING WEBS OF PHOTOSENSITIVE MATERIAL IN COPYING MACHINES OR THE LIKE

[75] Inventors: Horst Wildner; Heinz Kölbl; Alois Zachmeier, all of Munich, Fed. Rep. of Germany

[73] Assignee: AGFA-Gevaert, A.G., Leverkusen, Fed. Rep. of Germany

[21] Appl. No.: 912,057

[22] Filed: Jun. 2, 1978

[30] Foreign Application Priority Data

Jun. 2, 1977 [DE] Fed. Rep. of Germany ..... 7717386

[51] Int. Cl.[2] ..... B26D 5/08

[52] U.S. Cl. ..... 83/577; 83/588; 83/635; 83/824

[58] Field of Search ..... 83/577, 635, 821, 824, 83/588

[56] References Cited

U.S. PATENT DOCUMENTS

| | | | |
|---|---|---|---|
| 483,095 | 9/1892 | Barrow | 83/635 |
| 2,146,086 | 2/1939 | Muller | 83/635 |
| 2,825,406 | 3/1958 | Hagopian | 83/577 |
| 3,065,657 | 11/1962 | Thompson | 83/635 X |
| 3,117,479 | 1/1964 | Bisbis | 83/577 X |
| 3,130,623 | 4/1964 | Nesbitt | 83/635 X |
| 3,667,334 | 6/1972 | Brunett | 83/577 X |

FOREIGN PATENT DOCUMENTS

| | | | |
|---|---|---|---|
| 1449653 | 2/1969 | Fed. Rep. of Germany | 83/577 |

*Primary Examiner*—Frank T. Yost
*Attorney, Agent, or Firm*—Peter K. Kontler

[57] ABSTRACT

Apparatus for making holes in a web of photosensitive material which is transported in a copying machine has an electromagnet with a reciprocable armature connected to one leg of a U-shaped carrier. The other leg of the carrier supports a material removing tool which penetrates through the web when the electromagnet is energized. The carrier is held against wobbling by a ball bearing which is connected to its one leg and extends with minimal clearance between two parallel guide faces which are machined into a stationary holder for the electromagnet. The holder has a plate-like extension with a hole which receives the tip of the tool subsequent to penetration of such tip through the web. The tool is normally located at one side of the plane of the web, and the extension is located at the other side of such plane. The clearance between the bearing and the guide faces is less than that clearance which would permit such lateral movement of the tool that the latter would fail to penetrate into the hole of the extension in response to energization of the electromagnet.

9 Claims, 1 Drawing Figure

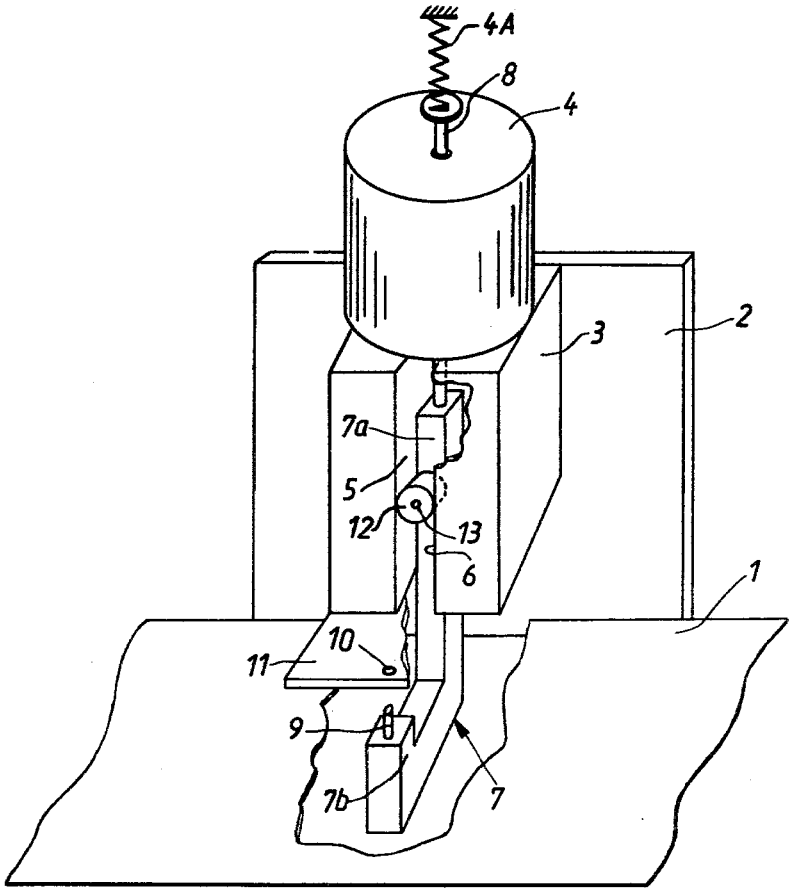
4A
8
4
3
2
7a
5
12
13
6
1
10
11
9
7b
7

APPARATUS FOR PERFORATING WEBS OF PHOTOSENSITIVE MATERIAL IN COPYING MACHINES OR THE LIKE

BACKGROUND OF THE INVENTION

The present invention relates to apparatus for perforating webs of photographic material in photographic copying machines or the like. More particularly, the invention relates to improvements in apparatus for applying indicia (preferably in the form of holes or perforations) to webs of photographic paper, photographic film or like material to identify film frames, successive latent prints, the last print of a customer order, the last frame of a film and/or the splices between successive films of a series of interconnected films.

It is customary to identify each frame of a developed and exposed film and/or each print on a web of photographic paper by indicia in the form of graphite marks, exposed spots, notches in the marginal portions and/or perforations. Such indicia render it possible to accurately position the film frames during reproduction of their images or to accurately position successive prints during severing of a web of exposed and developed photographic paper. Heretofore known methods of applying indicia include stamping, punching, imprinting, exposure to light, drawing or the application of adhesive-coated patches.

In certain presently known photographic copying machines, the application of notches, holes, perforations and like indicia which involves removal of material from the web is effected by a tool which engages the web and is moved by means of a linkage because the prime mover is much too large to allow for installation in immediate proximity of the indicia applying station. Such station is often or almost invariably immediately adjacent to the path of printing light. It was further proposed to mount the material removing tool directly on the output element of the prime mover, e.g., on the armature of an electromagnet. This also presents serious problems, especially vignetting.

OBJECTS AND SUMMARY OF THE INVENTION

An object of the invention is to provide a novel and improved apparatus which can be utilized to apply indicia to webs of photographic material in a photographic copying machine in such a way that the indicia can be applied with a high degree of accuracy and that the mounting of the apparatus close to the path of printing light does not affect the quality of reproductions.

Another object of the invention is to provide a novel and improved connection between the prime mover and the indicia applying tool of the improved apparatus.

A further object of the invention is to provide a versatile apparatus which can be used for the application of indicia to different types of photographic material or other elongated web stock.

The invention is embodied in an apparatus for applying indicia to selected portions of a web of photosensitive material in a copying machine wherein the web is transported along a predetermined path. The apparatus comprises a prime mover (e.g., an electromagnet) having a reciprocable output element (such element is the armature if the prime mover is an electromagnet) which is adjacent to one marginal portion of the web in the aforementioned path and whose axis is preferably normal to the plane of the adjacent portion of the web, a preferably U-shaped carrier including a first portion (such first portion may constitute the longer leg of the U-shaped carrier) which is connected to and preferably coaxial with the output element so that it shares the reciprocatory movements of the output element and a second portion (this portion may constitute a shorter second leg of the U-shaped carrier which is parallel to the longer leg) spaced apart from the first portion of the carrier, and an indicia-applying tool (preferably a tool which can remove material from the web) which is provided on the second portion of the carrier. The output element of the prime mover is movable between first and second positions in which the tool is respectively remote from the path and applies an indicium to the adjacent portion of the web in the path.

The apparatus preferably further comprises a stationary holder which may form part of a frame of the apparatus and may support the prime mover. The holder has two elongated guide faces which are parallel to the axis of the output element, and the first portion of the carrier is connected with a shaft which is preferably normal to the axis of the output element and supports an antifriction bearing (e.g., a ball bearing with a cylindrical outer race) which is disposed between the guide faces to determine the permissible extent of movement of the second portion of the carrier about the axis of the output element. Still further, and especially if the tool is a punching or stamping tool which removes material from the web during movement of the output element from the first to the second position, the apparatus preferably further comprises a stationary member (e.g., a plate-like extension of the aforementioned holder) which has a hole in register with the tool to receive the tool when the output element of the prime mover assumes the second position. The clearance with which the bearing is received between the guide faces of the holder is sufficiently small to invariably insure that the tool enters the hole of the aforementioned stationary member in response to movement of the output element to the second position. The stationary member is located at one side of the aforementioned path (e.g., at a level above the web), and the tool is located at the other side of such path when the output element assumes its first position.

The electromagnet may comprise or may be associated with one or more springs or analogous means for yieldably biasing the output element to one of its positions (e.g., to the first position). The output element moves to the other position in response to energization of the electromagnet.

The tool applies indicia which can be used to identify the trailing end of a web of photosensitive material, to identify successive film frames or prints, to identify splices between neighboring customer films, and for related purposes. Such tool can apply any one of several types of indicia; it is preferred, at this time, to employ a tool which is capable of removing some material from the web, e.g., which can form circular holes.

The apparatus of the present invention can be used as a substitute for one of the indicia applying apparatus which are disclosed in commonly owned U.S. Pat. No. 4,088,404 granted on May 9, 1978 to Zahn et al. Furthermore, the apparatus can be used to apply indicia in machines of the type disclosed in commonly owned U.S. Pat. No. 4,039,258 granted on Aug. 2, 1977 to Hujer et al.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a perspective view of an indicia applying apparatus which embodies the invention, with the electromagnet shown in deenergized condition.

DESCRIPTION OF THE PREFERRED EMBODIMENTS

The drawing shows a portion of a photographic copying machine wherein a web 1 of photographic paper or other photosensitive material is to be provided with indicia in the form of perforations. The source of printing light (not shown) is assumed to be disposed at a level below the plane of the web 1. The perforating apparatus comprises a frame 2 which includes or supports a stationary block-shaped holder 3 for an electromagnet 4 having a reciprocable armature 8. The holder 3 has an elongated groove or recess which extends at right angles to the plane of the web 1 and is bounded by two guide faces 5 and 6 which are parallel to the armature 8. The inner portion of the recess confines a longer portion or leg *7a* of a generally U-shaped carrier *7a* shorter portion or leg *7b* of which is provided with a perforating tool 9. The longer leg *7a* is connected with the armature 8 of the electromagnet 4. The axis of the perforating tool 9 is parallel to the armature 8. The tool 9 is a punch which can remove a circular portion from the adjacent part of the web 1 when the electromagnet 4 is energized to move the armature 8 upwardly, as viewed in the drawing. A spring 4A is provided to yieldably bias the armature 8 to the lower end position which is shown in the drawing. This spring can be installed in the interior of the electromagnet 4. When the electromagnet 4 is energized and the carrier 7 moves upwardly, the tool 9 penetrates through the web 1 and its tip enters from below a guide hole 10 which is machined into a plate-like member or extension 11 of the holder 3. The upper side of the web 1 abuts against the underside of the extension 11 when the holder 7 performs a working stroke, i.e., when the armature 8 moves to the upper end position.

The longer arm *7a* of the holder 7 carries a shaft 13 for an antifriction ball bearing 12 which is received between the guide faces 5, 6 and holds the carrier 7 against excessive angular movement about the axis of the armature 8. The shaft 13 is normal or substantially normal to the armature. The distance between the faces 5, 6 slightly exceeds the outer diameter of the ball bearing 12 so that the bearing rolls along one of the guide faces 5, 6 and is out of contact with the other guide face when the electromagnet 4 is energized to move the armature 8 upwardly or when the armature 8 is moved in response to the bias of the spring 4A. However, the clearance between the bearing 12 and the other guide face is smaller than that clearance which would be necessary for the tool 9 to strike against the extension 11 rather than to enter the guide hole 10 while the carrier 7 performs an upward stroke.

The operation is as follows:

When the electromagnet 4 is energized (in a manner known per se and not shown in the drawing), the armature 8 moves the carrier 7 upwardly whereby the tool 9 removes material from or makes a hole in the web 1 and thereupon enters the hole 10 of the extension 11 of the stationary holder 3. When the electromagnet 4 is deenergized, the spring 4A returns the carriage 7 to the lower end position so that the tool 9 is withdrawn from the hole 10 and thereupon from the perforation in the web 1. As mentioned above, the bearing 12 rolls along the guide face 5 or 6 while the carriage 7 moves as a result of energization or deenergization of the electromagnet 4.

An important advantage of the improved apparatus is that it occupies little room and, therefore, such apparatus can be installed in immediate proximity of the path of printing light without any danger of vignetting. This will be readily appreciated since the prime mover (electromagnet) 4 is mounted at one side and the source of light is located at the other side of the path along which the web 1 moves in the copying machine.

In conventional apparatus wherein the tool is mounted directly on the armature of the electromagnet, the problem of angular displacement does not arise at all, especially if the tool is a cylindrical or annular body. In other words, in such perforating apparatus, the armature need not be held against angular movement since it is immaterial whether the angular position of the cylindrical or annular tool changes during movement into engagement with the web. However, excessive angular displacements of the tool 9 are undesirable in the apparatus of the present invention. Therefore, the apparatus is provided with the aforementioned stationary holder 3 and bearing 12 to reduce the wobbling of the shorter leg *7b* of the carrier 7 to a permissible minimum, i.e., to insure that the tool 9 always enters the hole 10 of the extension 11 after it has penetrated through the web 1. As a rule, the lateral play of the tool 9 should not exceed two hundredths of one millimeter. Such tolerances can be readily maintained with the above described arrangement, i.e., by placing of the bearing 12 between two parallel guide faces 5, 6 which flank the bearing with minimal play. In spite of the fact that the tool 9 of the improved apparatus is not mounted directly on the output element (8) of the prime mover (4), the energy requirements of the improved apparatus do not exceed at all or exceed only slightly the energy requirements of apparatus wherein the tool is mounted on or constitutes the output element of the prime mover. Moreover, the improved apparatus insures that friction between the carrier 7 and the holder 3 during movement of the armature 8 against the opposition of or under the bias of the spring 4A is negligible.

The bearing 12 can be installed on the shorter leg *7b* or on the web of the carrier 7. Furthermore, the carrier 7 can support several bearings. The holder 3 is then modified accordingly or the apparatus comprises additional means de.ining guide faces for the otherwise mounted or additional bearings.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for applying indicia to selected portions of a web of photosensitive material in a copying machine wherein the web is transported along a predetermined path, comprising a prime mover having a reciprocable output element; a carrier including a first portion connected with said output element and a second portion spaced apart from said first portion; an indicia-applying tool on said second portion of said carrier, said output element being movable between first and second positions in which said tool is respectively remote from said path and applies an indicium to the web in said path; a stationary holder having two guide faces extending in parallelism with the direction of reciprocatory movement of said output element; and an antifriction bearing rotatable about an axis which is substantially normal to the axis of said output element, said bearing being secured to said carrier and being disposed between said guide faces.

2. Apparatus as defined in claim 1, wherein said carrier is U-shaped and said first and second portions respectively constitute substantially parallel first and second legs of said carrier.

3. Apparatus as defined in claim 2, wherein one of said legs is shorter than the other of said legs.

4. Apparatus as defined in claim 2, wherein said first leg is coaxial with said output element.

5. Apparatus as defined in claim 1, wherein said bearing is a ball bearing.

6. Apparatus as defined in claim 1, wherein said prime mover is an electromagnet and said output element is the armature of said electromagnet.

7. Apparatus as defined in claim 6, wherein said electromagnet is energizable to move said armature to one of said positions and further comprising means for yieldably biasing said armature to the other of said positions.

8. Apparatus as defined in claim 1, wherein said tool includes means for removing material from the web in said path and is located at one side of said path in the first position of said output element, and further comprising a stationary member disposed at the other side of said path and having a hole in register with said tool, said tool extending through the web in said path and into said hole in said second position of said output element.

9. Apparatus for applying indicia to selected portions of a web of photosensitive material in a copying machine wherein the web is transported along a predetermined path, comprising a prime mover having a reciprocable output element; a carrier including a first portion connected to said output element and a second portion spaced apart from said first portion; an indicia-applying tool on said second portion of said carrier, including means for removing material from the web in said path, said output element being movable between first and second positions in which said tool respectively is remote from said path at one side of the latter, and applies an indicium to the web in said path; a stationary member disposed at the other side of said path and having a hole in register with said tool, said tool extending through the web in said path and being received in said hole with a first clearance in said second position of said output element; a stationary holder having two guide faces extending in parallelism with the direction of movement of said output element; and a bearing secured to said first portion of said carrier and disposed between said guide faces with a second clearance which is sufficiently small to insure that said tool invariably enters said hole on movement of said output element to said second position.

* * * * *